US008701399B2

(12) United States Patent
Horii

(10) Patent No.: US 8,701,399 B2
(45) Date of Patent: Apr. 22, 2014

(54) HYDRAULIC SYSTEM FOR WORKING MACHINE

(75) Inventor: Hiroshi Horii, Osaka (JP)

(73) Assignee: Kubota Corporation, Osaka (JP)

( * ) Notice: Subject to any disclaimer, the term of this patent is extended or adjusted under 35 U.S.C. 154(b) by 663 days.

(21) Appl. No.: 13/053,190

(22) Filed: Mar. 21, 2011

(65) Prior Publication Data

US 2012/0067443 A1 Mar. 22, 2012

(30) Foreign Application Priority Data

Sep. 21, 2010 (JP) ..... 2010-210938

(51) Int. Cl.
*E02F 9/22* (2006.01)

(52) U.S. Cl.
USPC ..... 60/421; 60/486

(58) Field of Classification Search
USPC ..... 60/421, 422, 484, 486
See application file for complete search history.

(56) References Cited

U.S. PATENT DOCUMENTS

| | | | | |
|---|---|---|---|---|
| 5,211,014 | A * | 5/1993 | Kropp | 60/421 |
| 6,276,133 | B1 * | 8/2001 | Yoshida et al. | 60/421 |
| 6,799,424 | B2 * | 10/2004 | Ioku et al. | 60/486 |
| 7,069,674 | B2 * | 7/2006 | Arii | 60/422 |
| 7,350,353 | B2 * | 4/2008 | Ioku | 60/421 |
| 7,571,558 | B2 * | 8/2009 | Horii | 60/421 |
| 7,743,611 | B2 * | 6/2010 | Horii | 60/421 |
| 2003/0089106 | A1 | 5/2003 | Ioku et al. | |
| 2004/0123499 | A1 | 7/2004 | Arii | |
| 2006/0236688 | A1 | 10/2006 | Ioku | |

FOREIGN PATENT DOCUMENTS

| | | | |
|---|---|---|---|
| DE | 103 54 022 | A1 | 6/2004 |
| JP | 55-106267 | U | 7/1980 |
| JP | 57-197333 | A | 12/1982 |
| JP | 2006-161510 | A | 6/2006 |

* cited by examiner

*Primary Examiner* — Thomas E Lazo
(74) *Attorney, Agent, or Firm* — Birch, Stewert, Kolasch & Birch, LLP

(57) ABSTRACT

A pair of dozer control valves V3, V6 concurrently operable; a pilot pressure valve V14 switchable between an independent position 27 where, when only track devices 5 are operated, discharged fluid from one hydraulic-fluid discharge port P1 is independently supplied to one track control valve and one dozer control valve, and discharged fluid from the other hydraulic-fluid discharge port P2 is independently supplied to the other track control valve and the other dozer control valve, and a merging position 28 where, when the other control valves are operated, discharged fluid from the one hydraulic-fluid discharge port and from the other hydraulic-fluid discharge port are merged and supplied to the control valves V1 to 10; and pressure compensation valves V11 in the control valves and for distributing hydraulic fluid at flow rates based on extent of actuation of the other control valves operated, irrespective of the magnitude of the loads.

6 Claims, 7 Drawing Sheets

HYDRAULIC SYSTEM FOR WORKING MACHINE

CROSS REFERENCE TO RELATED APPLICATION

The disclosure of Japanese Patent Application No. 2010-210938, filed on Sep. 21, 2010, is incorporated herein by reference.

BACKGROUND OF THE INVENTION

1. Field of the Invention

The present invention relates to hydraulic systems for working machines, and in particular, to hydraulic systems for working machines provided with a pair of track devices and a dozer device.

2. Description of the Background Art

Working machines provided with a pair of track devices and a dozer device, such as, for example, the working machine disclosed in Japanese Laid-Open Patent Publication No. 2006-161510, have been proposed to date.

The working machine according to this reference is provided with a swivel base configured to swivel about a vertical axis on a track body which is equipped with a dozer device on a front part thereof, and a digging device furnished on a front part of the swivel base.

The track body includes a pair of left and right crawler track devices which are driven by a track drive motor, and the dozer device includes a blade which is moved up and down by means of a dozer cylinder.

The swivel base is swiveled by a swivel motor.

A swing bracket configured to be swung left and right about the vertical axis is provided on the front part of the swivel base. The swing bracket is swung left and right by a swing cylinder.

The digging device includes a boom pivotally connected to the swing bracket, an arm pivotally connected to the boom, and a bucket pivotally connected to the arm. The boom is swung by a boom cylinder, the arm is swung by an arm cylinder, and the bucket is swung by a bucket cylinder.

The track drive motor and the swivel motor are each constituted by a hydraulic motor, and the dozer cylinder, the swing cylinder, the boom cylinder, the arm cylinder, and the bucket cylinder are each constituted by a hydraulic cylinder.

The working machine is equipped with a hydraulic system including a load sensing system.

The hydraulic system includes: a first pump and a second pump whose discharge flow rates can be controlled; a third pump whose discharge flow rate is not controlled; a flow control section for controlling the discharge flow rates of the first and second pumps; and a pilot pressure valve for switching the direction of discharged fluid from the first pump and the second pump.

The pilot pressure valve is switchable between an independent position in which hydraulic fluid from the first pump and hydraulic fluid from the second pump are supplied independently to left and right track control valves, respectively, and a merging position in which the hydraulic fluid from the first pump and the hydraulic fluid from the second pump are merged and then supplied to a boom control valve, an arm control valve, a bucket control valve, and a swing control valve. The pilot pressure valve is switched to the independent position in a running state of the working machine, and to the merging position in a non-running state of the working machine.

Discharged fluid from the third pump can be supplied to a swivel control valve and a dozer control valve in the non-running state, and can be supplied additionally to the boom control valve, the arm control valve, the bucket control valve, and the swing control valve in the running state.

Each of the boom control valve, the arm control valve, the bucket control valve, and the swing control valve includes a direction switching valve for switching the direction of the hydraulic fluid with respect to a corresponding hydraulic actuator to be controlled, and in addition, includes a pressure compensation valve configured to adjust, when more than one of the hydraulic actuators under control of these control valves are concurrently operated, the loads among the concurrently operated hydraulic actuators.

The pressure compensation valve in a corresponding control valve having a lower load pressure generates a pressure loss equivalent to the differential pressure between the control valve having a lower load pressure and a control valve having the maximum load pressure, thereby realizing a flow rate corresponding to the extent to which the spool in the corresponding control valve is moved, irrespective of the magnitude of the load applied.

Further, in the hydraulic system, in a case where more than one of the boom cylinder, the arm cylinder, the bucket cylinder, and the swing cylinder are concurrently operated in the non-running state, the maximum load pressure of the load pressures acting on the operated hydraulic actuators (hereinafter referred to as PLS signal pressure) is transmitted to the flow control section. Also, the discharge pressure of merged fluid of the discharged fluid from the first pump and the discharged fluid from the second pump (hereinafter referred to as PPS signal pressure) is transmitted to the flow control section. Then, the flow control section automatically controls the discharge flow rates of the first pump and the second pump such that "PPS signal pressure—PLS signal pressure" is maintained at a set value.

In an actual job, with respect to earthwork using the dozer device (blade), the blade is often moved while the working machine is running (for example, in a case where gravel or dry sand is spread by using the blade, the blade is often moved up and down while the working machine is running, so that the gravel or the dry sand is spread evenly. In paving work or the like, in order to grade the surface, the blade is manipulated in order to adjust the tilt of the working machine while the working machine is running).

In the working machine disclosed in the abovementioned reference, in a case where the dozer device is operated while the working machine is running, one of the left and the right track drive motors is driven by means of the discharged fluid from the first pump, and the other of the left and the right track drive motors is driven by means of the discharged fluid from the second pump. In addition, the dozer device is driven by the third pump in order to ensure the straightness of its running and the turning performance of the track device. However, when the dozer cylinder or the like is not operated, the third pump is driven to no avail. This results in low system efficiency.

A circuit configuration that allows the hydraulic actuators included in the working machine (backhoe) to be operated only by the first and the second pumps would eliminate the third pump, and improve the system efficiency. However, in a case where the dozer device is driven when the backhoe is running, if independently one of the left and the right track drive motors is driven by means of the discharged fluid from the first pump, and the other of the left and the right track drive motors is driven by means of the discharged fluid from the second pump, and further the dozer cylinder is driven by means of the discharged fluid from one of the above hydraulic pumps, some of the discharged fluid from the one of the above hydraulic pumps is drawn by the dozer cylinder. This results in a poor straightness in running and extremely poor turning performance.

Therefore, usually, in the case of the circuit configuration that allows the hydraulic actuators included in the backhoe to be driven by the first and the second pumps, the following circuit configuration is employed. That is, in a case where the backhoe just runs, the hydraulic fluid from the first pump and the hydraulic fluid from the second pump are independently supplied to the left and the right track control valves, respectively, and in a case where the dozer device is driven when the backhoe is running, the discharged fluid from the first pump and the discharged fluid from the second pump are merged and then supplied to the left and the right track control valves and the dozer control valve.

However, with this circuit configuration, the independence between the left run and the right run cannot be maintained when the dozer device is driven. Therefore, there remains a problem that the system exhibits poor turning performance.

Therefore, a hydraulic system is desired that is based on a hydraulic system in which the track drive motors, the dozer cylinder, and other hydraulic actuators included in the working machine are driven by use of hydraulic fluid from two independent hydraulic-fluid discharge ports, and that can ensure an independent circuit configuration in which even when the dozer device is operated while the working machine is running, the hydraulic fluid from one hydraulic-fluid discharge port is supplied to one track control valve, and, independently, the hydraulic fluid from the other hydraulic-fluid discharge port is supplied to the other track control valve.

SUMMARY OF THE INVENTION

In view of the above, an object of the present invention is to provide a hydraulic system for a working machine that is based on a hydraulic system in which a track drive motor, a dozer cylinder, and other hydraulic actuators included in a working machine are driven by use of hydraulic fluid from two independent hydraulic-fluid discharge ports, and that is intended to ensure the straightness in running and the turning performance at the time when the track device and the dozer device are concurrently operated.

In order to attain the above object, technical means provided by the present invention has the following features.

A first aspect of the present invention is directed to A hydraulic system for a working machine comprising left and right track devices configured to be driven by separate track drive motors, a dozer device configured to be driven by a dozer cylinder, track control valves provided respectively for the left and right track devices, and for respectively controlling the track drive motors, auxiliary control valves for controlling, apart from the track drive motors and the dozer cylinder, hydraulic actuators, and two independent hydraulic-fluid discharge ports, the hydraulic system comprising:

a pair of dozer control valves configured to be concurrently operable for controlling the dozer cylinder;

a pilot pressure valve configured to be switchable between an independent position and a merging position, the independent position being a position that allows, when the left and right track devices are operated while the auxiliary control valves are not operated, hydraulic fluid from one of the hydraulic-fluid discharge ports to be independently supplied to one of the track control valves and to one of the dozer control valves, and hydraulic fluid from the other of the hydraulic-fluid discharge ports to be independently supplied to the other of the track control valves and to the other of the dozer control valves, the merging position being a position that allows, when at least one of the auxiliary control valves is operated, the hydraulic fluid from the one of the hydraulic-fluid discharge ports and the hydraulic fluid from the other of the hydraulic-fluid discharge ports to be merged and then supplied to the at least one of the auxiliary control valves that has been operated, and to the track control valves and the dozer control valves; and pressure compensation valves provided respectively in the control valves, and configured to distribute hydraulic fluid to the respective control valves at flow rates in accordance with extent of actuation of, irrespective of the magnitude of loads acting on, the hydraulic actuators.

In a second aspect of the present invention, the control valves include direction switching valves, respectively, for switching the direction of the hydraulic fluid, and the hydraulic system further includes:

a first detection fluid channel for detecting that, when at least one of the direction switching valves of the track control valves and the dozer control valves is operated, the at least one of the direction switching valves has been operated, so as to cause the pilot pressure valve to be switched to the independent position; and a second detection fluid channel for detecting that, when at least one of the direction switching valves of the auxiliary control valves is operated, the at least one of the direction switching valves has been operated, so as to cause the pilot pressure valve to be switched to the merging position.

In a third aspect of the present invention, the control valves are arranged in one direction, the one of the track control valves and the one of the dozer control valves are arranged side by side, the other of the track control valves and the other of the dozer control valves are arranged side by side, and the one of the track control valves and the one of the dozer control valves, and the other of the track control valves and the other of the dozer control valves are arranged with the pilot pressure valve interposed therebetween.

In a fourth aspect of the present invention, the hydraulic system for the working machine further includes:

a flow control section for automatically controlling a discharge flow rate of the hydraulic-fluid discharge ports, so as to maintain, at a set value, the difference between a discharge pressure of the hydraulic-fluid discharge ports and the maximum load pressure of load pressure(s) acting on an at least one of the hydraulic actuators having been operated;

a PLS signal fluid channel connected to the pressure compensation valves of the control valves via load transmission lines, respectively, and for transmitting, to the flow control section, the maximum load pressure of the load pressure(s) acting on the at least one of the hydraulic actuators having been operated, the PLS signal fluid channel being configured to be split into a line through which hydraulic fluid is suppliable from the one of the hydraulic-fluid discharge ports and a line through which hydraulic fluid is suppliable from the other of the hydraulic-fluid discharge ports, when the pilot pressure valve is set at the independent position; and unloading valves provided at a distal end of a hydraulic fluid supply channel in which the hydraulic fluid from the one of the hydraulic-fluid discharge ports flows, and at a distal end of a hydraulic fluid supply channel in which the hydraulic fluid from the other of the hydraulic-fluid discharge ports flows, respectively.

According to the present invention, the following effects can be realized.

According to the first aspect of the present invention, in the hydraulic system in which the left and right track drive motors, the dozer cylinder, and other hydraulic actuators included in the working machine can be driven by the hydraulic fluid from the two independent hydraulic-fluid discharge ports, the straightness in running and the turning performance of the working machine can be ensured at the time when the dozer device is operated while the working machine is running.

That is, in a case where the dozer device is operated while the working machine is running, hydraulic fluid from one of the hydraulic-fluid discharge ports is independently supplied to one of the track control valves and one of the dozer control valves, and hydraulic fluid from the other of the hydraulic-fluid discharge ports is independently supplied to the other of the track control valves and the other of the dozer control valves. At this time, the hydraulic fluid from the one of the hydraulic-fluid discharge ports and the hydraulic fluid from the other of the hydraulic-fluid discharge ports are evenly drawn by the pair of dozer control valves concurrently operated, and then the drawn hydraulic fluid is sent to the dozer cylinder. Therefore, the straightness in running of the working machine can be ensured.

Moreover, in a case where the working machine is turned left or right while the dozer device is being operated, the pressure compensation valves control the distribution of the flow rate. Therefore, even when the loads applied to the track drive motors are high, and the load applied to the dozer cylinder is low, the hydraulic fluid exceeding a set flow rate does not flow into the dozer cylinder. Therefore, an independent circuit configuration can be maintained in which the hydraulic fluid from the one of the hydraulic-fluid discharge ports is supplied to the one of the track control valves, and the hydraulic fluid from the other of the hydraulic-fluid discharge ports is supplied to the other of the track control valves, independently. In addition, since the hydraulic fluid from the one of the hydraulic-fluid discharge ports and the hydraulic fluid from the other of the hydraulic-fluid discharge ports are evenly drawn, the hydraulic fluid supply flow rates to the left and the right track drive motors can be ensured, respectively, and thus the turning performance can be ensured.

According to the second aspect of the present invention, a simpler circuit configuration can be realized of the detection fluid channel for detecting that at least one of the direction switching valves of the control valves has been operated.

According to the third aspect of the present invention, a simpler circuit configuration of the first detection fluid channel can be realized.

According to the fourth, fifth, and sixth aspects of the present invention, when the pilot pressure valve is switched to the independent position, the PLS signal fluid channel is split into a line in which the hydraulic fluid from the one of the hydraulic-fluid discharge ports is supplied, and a line in which the hydraulic fluid from the other of the hydraulic-fluid discharge ports is supplied. This eliminates load signal interference between the hydraulic fluid supply system extending from the one of the hydraulic-fluid discharge ports, and the hydraulic fluid supply system extending from the other of the hydraulic-fluid discharge ports. Accordingly, the function of the pressure compensation valves can be ensured.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
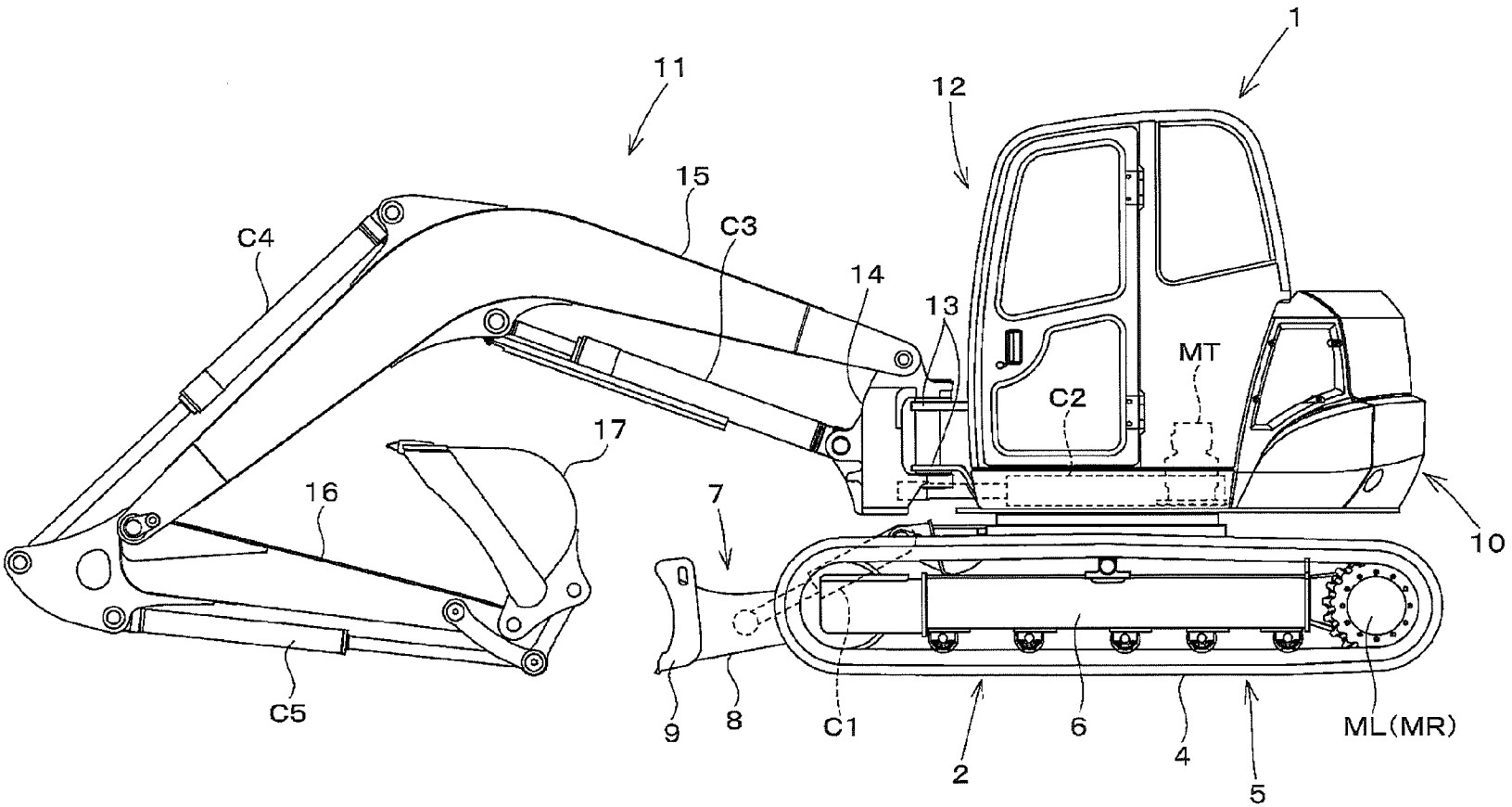
FIG. 1 is a side view showing a backhoe employing a hydraulic system according to the present invention.
Figure 2:
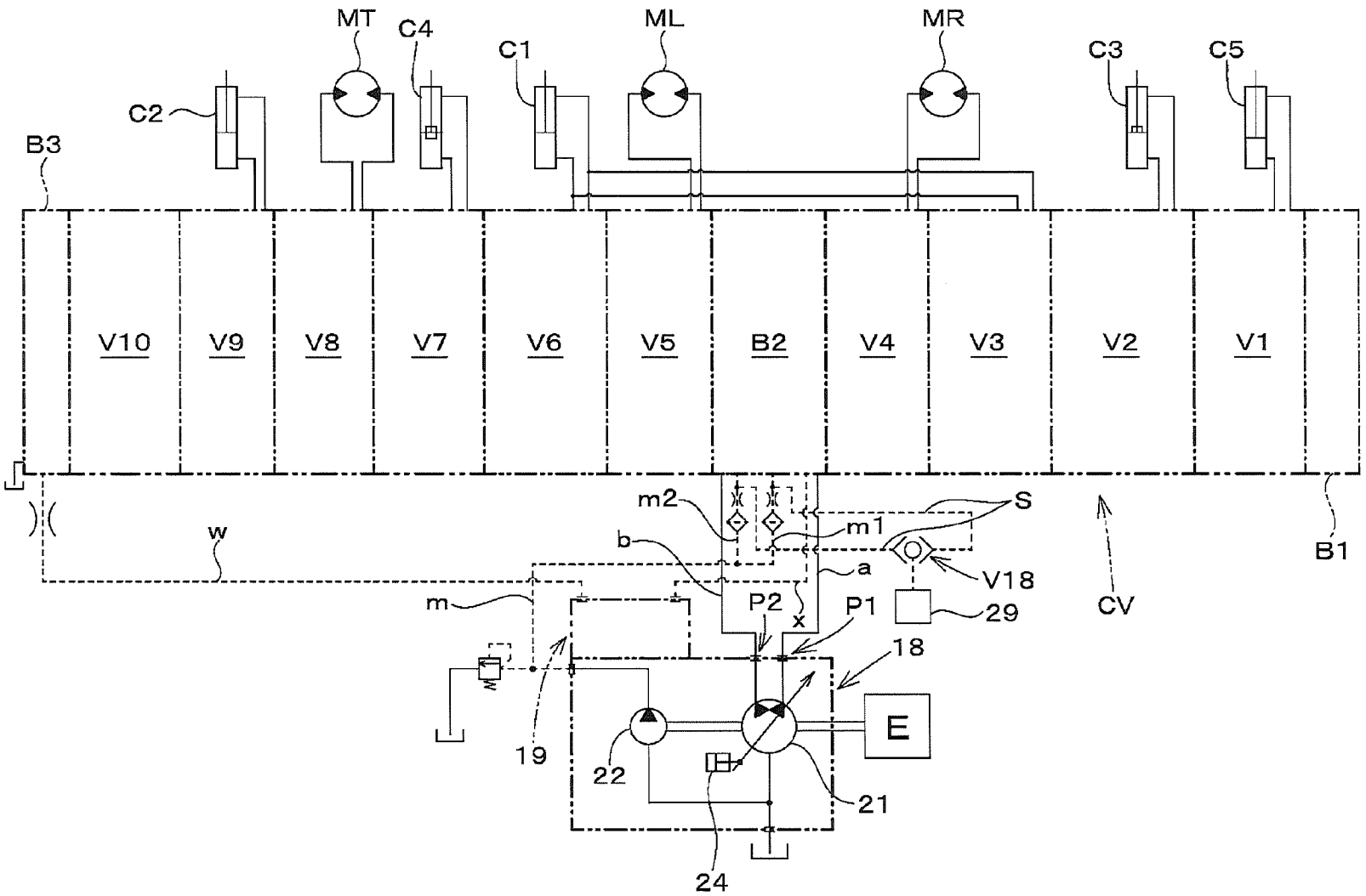
FIG. 2 is a schematic diagram showing an embodiment of the hydraulic system according to the present invention.
Figure 3:
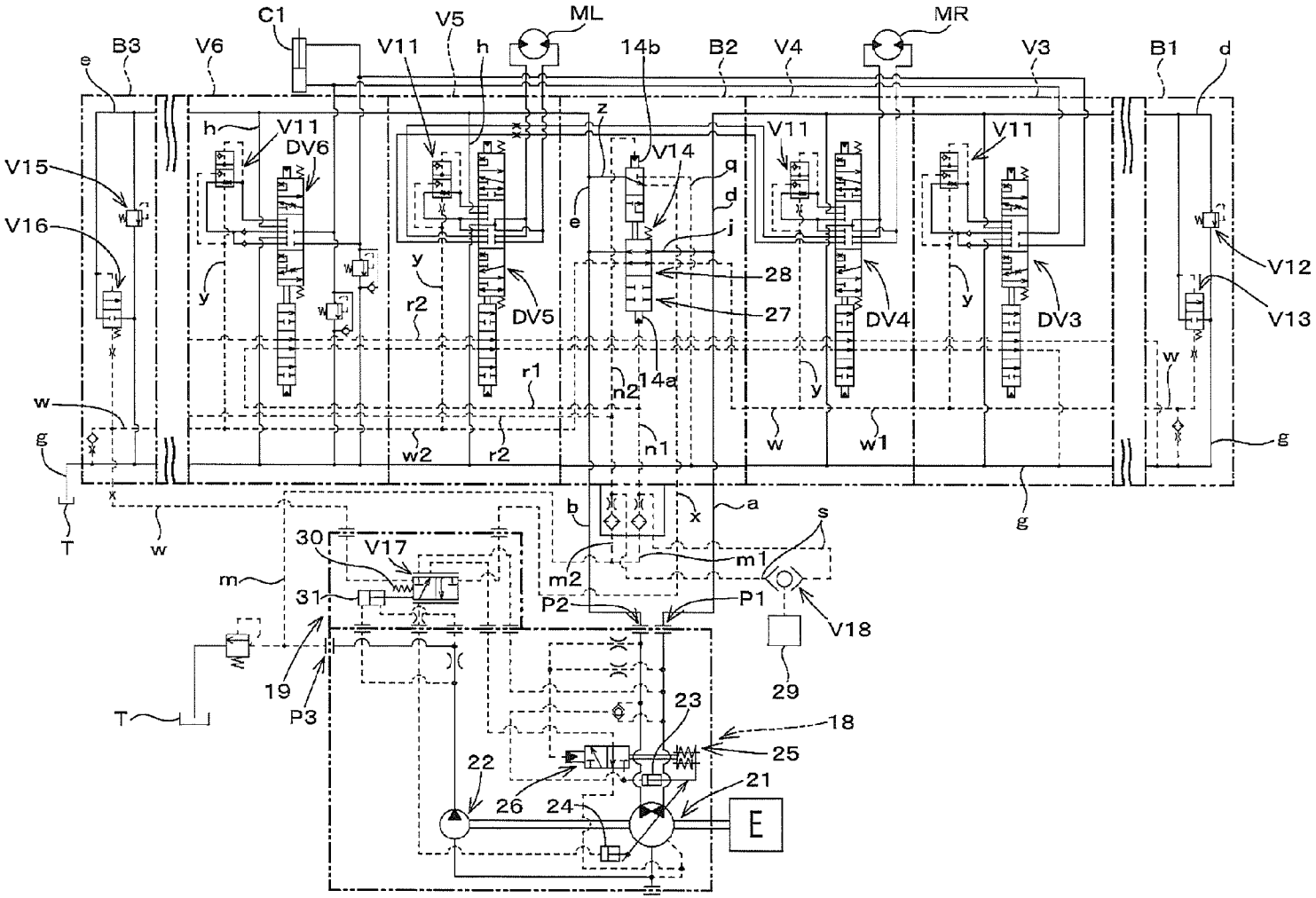
FIG. 3 is a hydraulic circuit diagram showing the embodiment of the hydraulic system according to the present invention.
Figure 4:
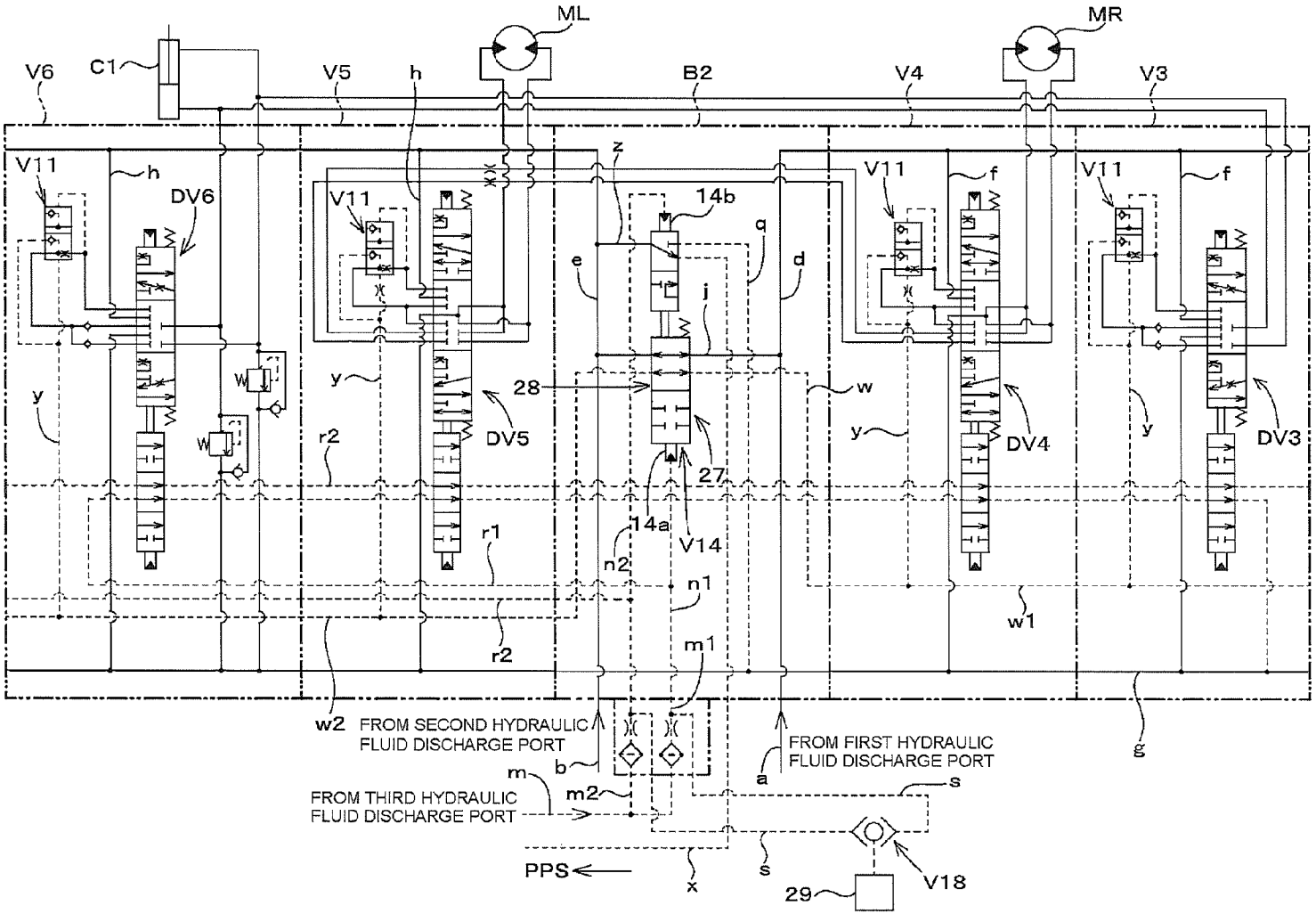
FIG. 4 is a hydraulic circuit diagram showing a part of the hydraulic system shown in FIG. 3.
Figure 5:
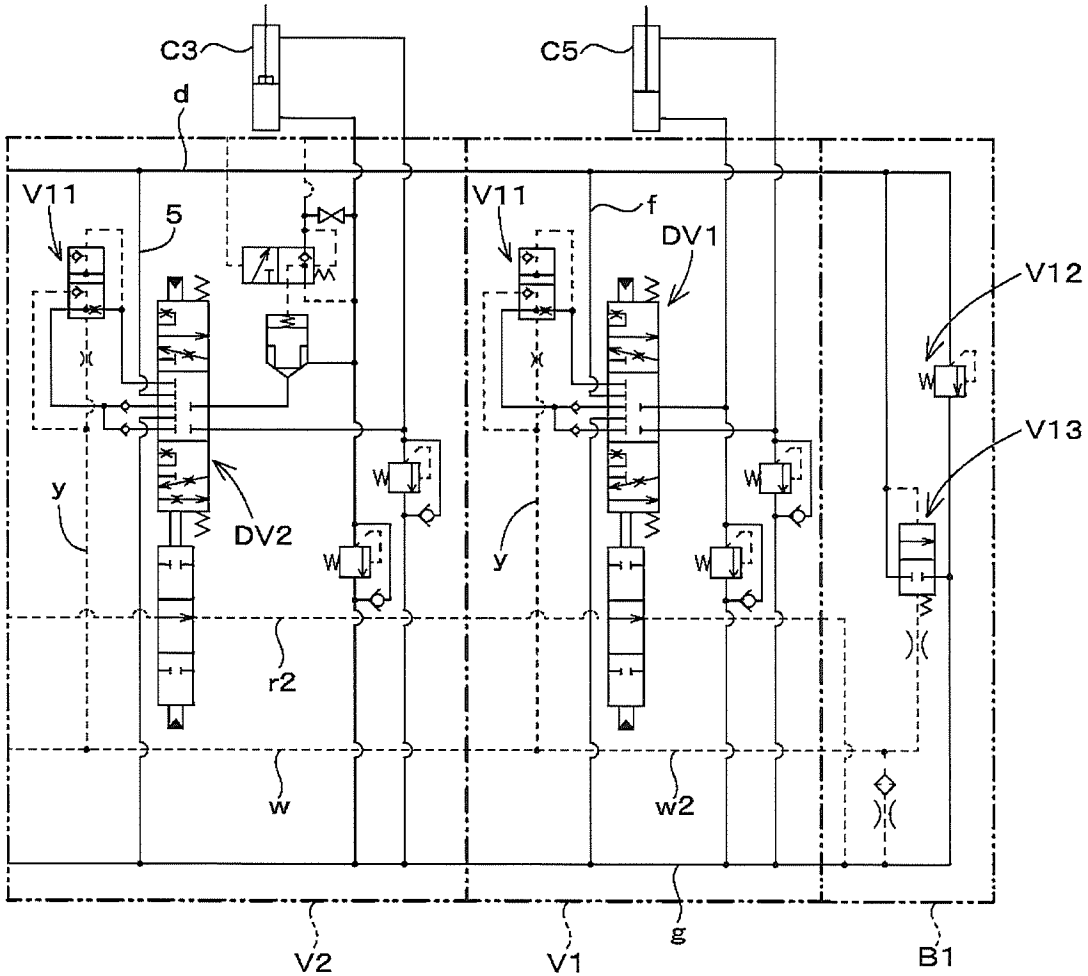
FIG. 5 is a hydraulic circuit diagram showing another part of the hydraulic system shown in FIG. 3.
Figure 6:
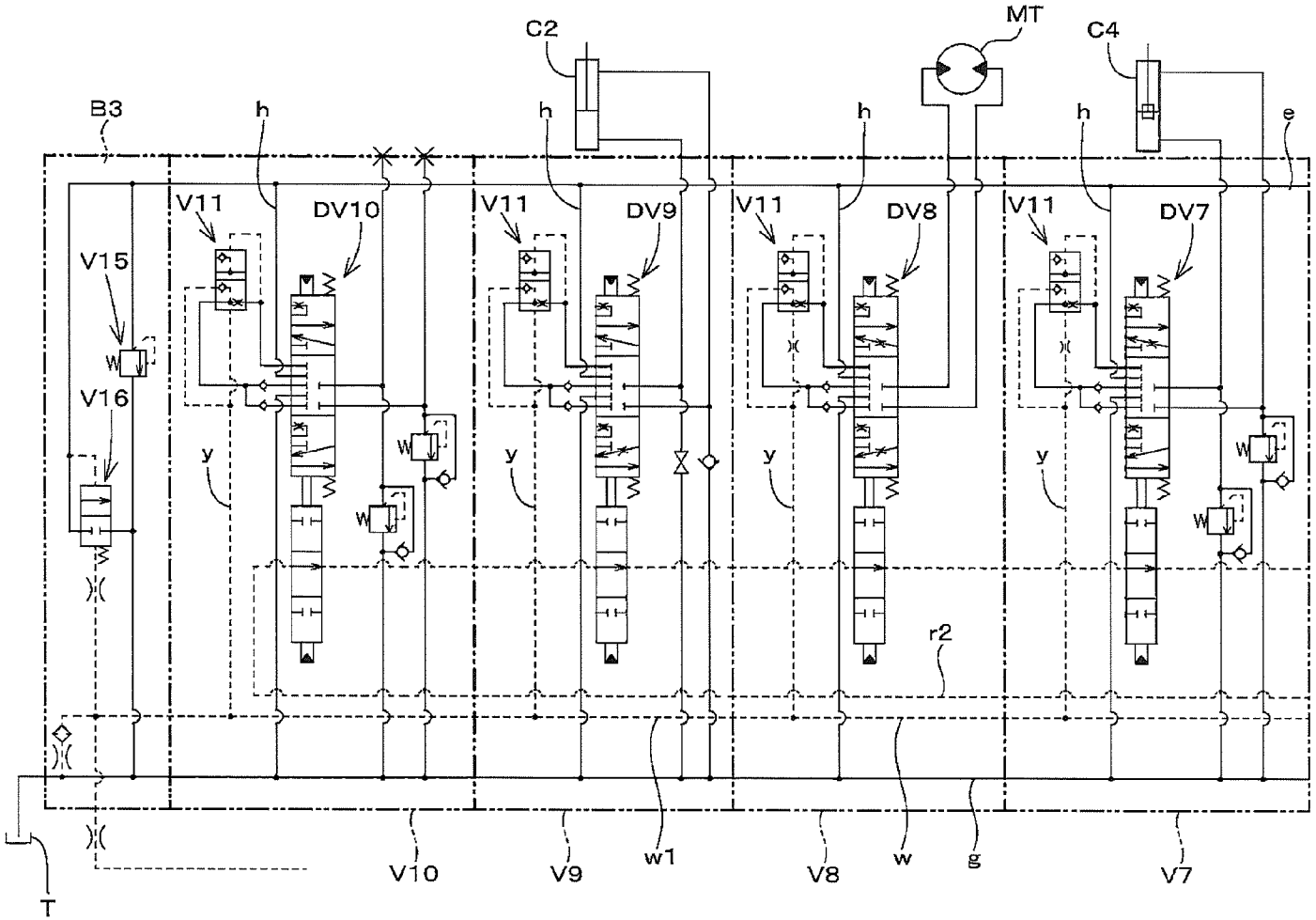
FIG. 6 is a hydraulic circuit diagram showing still another part of the hydraulic system shown in FIG. 3.
Figure 7:
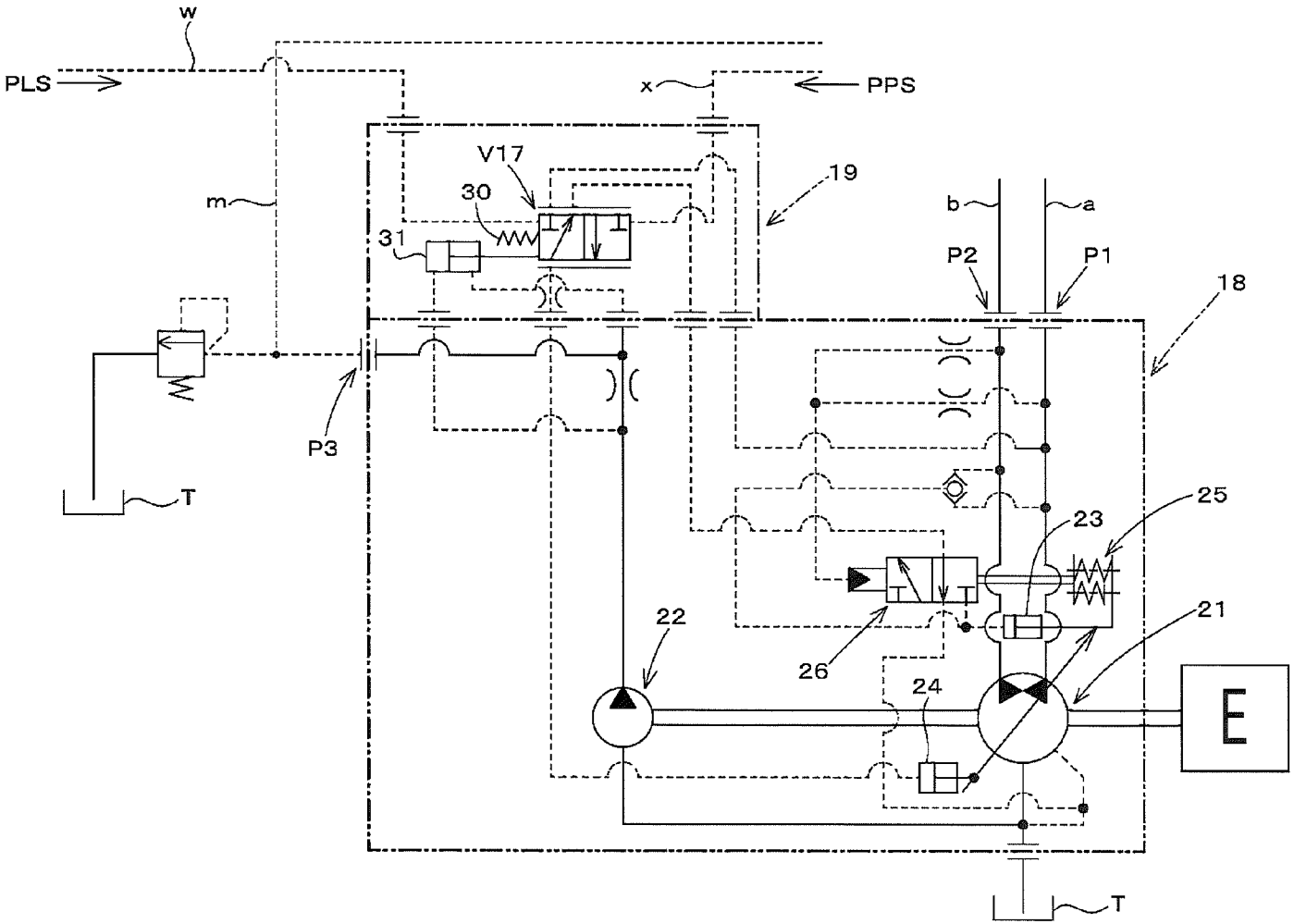
FIG. 7 is a hydraulic circuit diagram showing a flow control section and a hydraulic fluid supply unit in the hydraulic system shown in FIG. 3.

Hereinafter, an embodiment of the present invention will be described with reference to the drawings. FIG. 1 is a side view showing a backhoe employing a hydraulic system according to the present invention. FIG. 2 is a schematic diagram showing an embodiment of the hydraulic system according to the present invention. FIG. 3 is a hydraulic circuit diagram showing the embodiment of the hydraulic system according to the present invention. FIG. 4 is a hydraulic circuit diagram showing a part of the hydraulic system shown in FIG. 3. FIG. 5 is a hydraulic circuit diagram showing another part of the hydraulic system shown in FIG. 3. FIG. 6 is a hydraulic circuit diagram showing still another part of the hydraulic system shown in FIG. 3. FIG. 7 is a hydraulic circuit diagram showing a flow control section and a hydraulic fluid supply unit in the hydraulic system shown in FIG. 3.

In FIG. 1, reference numeral 1 denotes a backhoe (working machine). The backhoe 1 is mainly composed of a track body 2 provided at a lower part of the backhoe 1, and a swivel body 3 provided at an upper part of the backhoe 1, the swivel body 3 being mounted on the track body 2 and capable of fully swiveling about a vertical swivel axis.

The track body 2 is provided with crawler track devices 5 on the left side and the right side of a track frame 6, respectively, the crawler track devices 5 being configured such that endless crawler belts 4 are circumferentially cycled by track drive motors ML, MR which are composed of hydraulic motors, respectively.

A dozer device 7 is provided at a front part of the track frame 6. The dozer device 7 includes: a support arm 8 whose rear end is pivotally connected to the track frame 6, and which is capable of swinging up and down; and a blade 9 being attached to a front part of the support arm 8. The support arm 8 is driven up and down by extension and retraction of a dozer cylinder C1 composed of a hydraulic cylinder.

The swivel body 3 includes: a swivel base 10 mounted on the track frame 6 and capable of swiveling about a swivel axis; a digging device 11 mounted on a front part of the swivel base 10; and a cabin 12 mounted on the swivel base 10.

The swivel base 10 is provided with an engine E, a radiator, a fuel tank, a hydraulic fluid tank, a battery, and the like. The swivel base 10 is swiveled by a swivel motor MT composed of a hydraulic motor.

A support bracket 13 is provided at a front part of the swivel base 10 so as to protrude forward from the swivel base 10. A swing bracket 14 is supported by the support bracket 13 so as to be able to swing left and right about a vertical axis. The swing bracket 14 is swung left and right by a swing cylinder C2 composed of a hydraulic cylinder.

The digging device 11 is mainly composed of: a boom 15 whose base part is pivotally connected to an upper part of the swing bracket 14 so as to be able to rotate about a horizontal axis and which can swing up and down; an arm 16 which is pivotally connected to a distal end of the boom 15 so as to be able to rotate about a horizontal axis and which can swing forward and backward; and a bucket 17 which is pivotally connected to a distal end of the arm 16 so as to be rotate about a horizontal axis and which can swing forward and backward.

The boom 15 is swung by a boom cylinder C3 provided between the boom 15 and the swing bracket 14. The arm 16 is swung by an arm cylinder C4 provided between the arm 16 and the boom 15. The bucket 17 is swung by a bucket cylinder C5 provided between the bucket 17 and the arm 16.

Each of the boom cylinder C3, the arm cylinder C4, and the bucket cylinder C5 is composed of a hydraulic cylinder.

The backhoe 1 can be used with a hydraulic attachment such as a hydraulic breaker attached at the distal end of the arm 16, for example, instead of the bucket 17.

As described above, the backhoe 1 includes various hydraulic devices such as the crawler track devices 5, the dozer device 7, and the digging device 11. In the present invention, these hydraulic devices will be collectively referred to as heavy-equipment tools.

Next, with reference to FIG. 2 to FIG. 7, a hydraulic system for operating the hydraulic actuators ML, MR, MT, and C1 to C5 included in the backhoe 1 will be described.

As shown in FIG. 2, the hydraulic system includes a control valve CV, a hydraulic fluid supply unit 18, and a flow control section 19.

The control valve CV collectively includes control valves V1 to V10 for controlling the hydraulic actuators ML, MR, MT, C1 to C5; an inlet block B2 for receiving hydraulic fluid, a pair of outlet blocks B1, B3 for discharging the hydraulic fluid, these being arranged in one direction.

In the embodiment, the control valve CV is composed of: a first outlet block B1; a bucket control valve V1 for controlling the bucket cylinder C5; a boom control valve V2 for controlling the boom cylinder C3; a dozer first control valve V3 for controlling the dozer cylinder C1; a right track control valve V4 for controlling the track drive motor MR of the right-side crawler track device 5; the inlet block B2; a left track control valve V5 for controlling the track drive motor ML of the left-side crawler track device 5; a dozer second control valve V6 for controlling the dozer cylinder C1; an arm control valve V7 for controlling the arm cylinder C4; a swivel control valve V8 for controlling the swivel motor MT; a swing control valve V9 for controlling the swing cylinder C2; an SP control valve V10 for controlling a hydraulic attachment attached to the arm 16; and a second outlet block B3, which are arranged in this order (these are arranged from right to left in FIG. 2) and connected with each other.

As shown in FIG. 3 to FIG. 6, the control valves V1 to V10 include direction switching valves DV1 to DV10 and pressure compensation valves V11 in their valve bodies, respectively.

Each of the direction switching valves DV1 to DV10 switches the direction of hydraulic fluid for a corresponding one of the hydraulic actuators ML, MR, MT, and C1 to C5 to be controlled. Each pressure compensation valve V11 is provided downstream of, in terms of hydraulic fluid supply, a corresponding one of the direction switching valves DV1 to DV10, and upstream of, in terms of hydraulic fluid supply, a corresponding hydraulic actuator ML, MR, MT, and C1 to C5 to be controlled.

The first outlet block B1 includes a first relief valve V12 and a first unloading valve V13. The inlet block B2 includes a track independent valve (hereinafter referred to as pilot pressure valve) V14. The second outlet block B3 includes a second relief valve V15 and a second unloading valve V16.

Each of the direction switching valves DV1 to DV10 of the control valves V1 to V10 and the pilot pressure valve V14 is composed of a direct-drive spool switching valve, and also composed of a pilot operation switching valve which is switched by means of a pilot pressure.

Each direction switching valve (DV1 to DV10) of the corresponding control valve (V1 to V10) is configured such that a spool is moved in proportion to the extent of movement of a corresponding operating means controlling the direction switching valve (DV1 to DV10), and hydraulic fluid in an amount in proportion to the extent of movement of the spool is supplied to the corresponding hydraulic actuator (ML, MR, MT, and C1 to C5) to be controlled (the operation speed of the hydraulic actuators ML, MR, MT, and C1 to C5 can be varied in proportion to the extent to which the corresponding operating means is moved).

Further, the direction switching valve DV3 of the dozer first control valve V3 and the direction switching valve DV6 of the dozer second control valve V6 are concurrently operated by an operating means such as a dozer lever which operates the dozer device 7.

A hydraulic pump as a hydraulic fluid supply source in the hydraulic system includes a first pump 21 for supplying hydraulic fluid for operating the hydraulic actuators ML, MR, MT and C1 to C5; and a second pump 22 for supplying signal hydraulic fluid such as a pilot pressure and a detection signal.

The first pump 21 and the second pump 22 are provided in the hydraulic fluid supply unit 18, and are driven by the engine E mounted on the swivel base 10.

In the embodiment, the first pump 21 is composed of a swash plate variable-displacement axial pump which has a function of an equal-flow double pump which discharges hydraulic fluid in an equal amount from two independent hydraulic-fluid discharge ports P1 and P2.

Specifically, the first pump 21 employs a split-flow-type hydraulic pump having a mechanism in which hydraulic fluid is discharged from a piston-cylinder barrel kit, alternately to an inner discharge port and an outer discharge port which are formed in a valve plate.

One of the hydraulic-fluid discharge ports of the first pump 21 will be referred to as a first hydraulic-fluid discharge port P1, and the other of the hydraulic-fluid discharge ports of the first pump 21 will be referred to as a second hydraulic-fluid discharge port P2.

In the embodiment, the hydraulic-fluid discharge ports of the hydraulic pump having a function of two pumps are referred to as the first and the second hydraulic-fluid discharge ports P1, P2, respectively. However, the hydraulic-fluid discharge port of one of two individual hydraulic pumps may be used as a first hydraulic-fluid discharge port, and the hydraulic-fluid discharge port of the other of the two individual hydraulic pumps may be used as a second hydraulic-fluid discharge port.

The hydraulic fluid supply unit 18 further includes a pressing piston 23 for pressing the swash plate of the first pump 21, and a flow compensation piston 24 for controlling the swash plate of the first pump 21.

The first pump 21 is configured such that the swash plate is pressed by the pressure of the first pump 21 via the pressing piston 23, in a direction that increases the flow rate of the pump, and also the flow compensation piston 24 causes a force that counteracts the pressing force of the pressing piston 23 to act on the swash plate. Thus, by controlling the pressure acting on the flow compensation piston 24, the discharge flow rate of the first pump 21 is controlled.

Therefore, when the pressure acting on the flow compensation piston 24 is released, the swash plate angle of the first pump 21 becomes the maximum, and the first pump 21 discharges hydraulic fluid at the maximum flow rate.

The flow control section 19 controls the swash plate of the first pump 21. The control of the swash plate of the first pump 21 is performed by controlling the pressure acting on the flow compensation piston 24, by means of a flow compensation valve V17 provided in the flow control section 19.

Further, the hydraulic fluid supply unit 18 is further provided with a spring 25 and a spool 26 for controlling the pump horsepower (torque) of the first pump 21, and is configured such that, when the discharge pressure of the first pump 21 reaches a preset pressure, the first pump 21 limits the horsepower (torque) received from the engine E.

The second pump 22 is composed of a fixed-displacement gear pump, and discharged fluid from the second pump 22 is discharged from a third hydraulic-fluid discharge port P3.

The first hydraulic-fluid discharge port P1 is connected to the inlet block B2 via a first discharge channel a, and the second hydraulic-fluid discharge port P2 is connected to the inlet block B2 via a second discharge channel b.

The first discharge channel a is connected to a first hydraulic fluid supply channel d. The first hydraulic fluid supply channel d is formed to extend in the sequence of the inlet block B2, the valve body of the right track control valve V4, the valve body of the dozer first control valve V3, the valve body of the boom control valve V2, the valve body of the bucket control valve V1, and the first outlet block B1, in this order, and is branched in the first outlet block B1 (at the distal end of the flow channel) and connected to the first relief valve V12 and the first unloading valve V13.

The hydraulic fluid can be supplied from the first hydraulic fluid supply channel d, via hydraulic fluid branch channels f, to the direction switching valve DV4, DV3, DV2, and DV1 of the right track control valve V4, the dozer first control valve V3, the boom control valve V2, the bucket control valve V1, respectively.

The first relief valve V12 and the first unloading valve V13 are connected to a drain fluid channel g. The drain fluid channel g extends in the sequence of the first outlet block B1, the valve body of the bucket control valve V1, the valve body of the boom control valve V2, the valve body of the dozer first control valve V3, the valve body of the right track control valve V4, the inlet block B2, the valve body of the left track control valve V5, the valve body of the dozer second control valve V6, the valve body of the arm control valve V7, the valve body of the swivel control valve V8, the valve body of the swing control valve V9, the valve body of the SP control valve V10, and the second outlet block B3, in this order, and here the discharged fluid is drained into a tank T.

The second discharge channel b is connected to a second hydraulic fluid supply channel e. The second hydraulic fluid supply channel e is formed to extend in the sequence of the inlet block B2, the valve body of the left track control valve V5, the valve body of the dozer second control valve V6, the valve body of the arm control valve V7, the valve body of the swivel control valve V8, the valve body of the swing control valve V9, the valve body of the SP control valve V10, and the second outlet block B3, in this order, and is branched in the second outlet block B3 (at the distal end of the flow channel) and connected to the second relief valve V15 and the second unloading valve V16.

The hydraulic fluid can be supplied from the second hydraulic fluid supply channel e, via hydraulic fluid branch channels h, to the direction switching valves DV5, DV6, DV7, DV8, DV9, and DV10 of the left track control valve V5, the dozer second control valve V6, the arm control valve V7, the swivel control valve V8, the swing control valve V9, the SP control valve V10, respectively.

The second relief valve V15 and the second unloading valve V16 are connected to the drain fluid channel g.

The first hydraulic fluid supply channel d and the second hydraulic fluid supply channel e are connected to each other via a communication passage j passing through the pilot pressure valve V14 in the inlet block B2.

The pilot pressure valve V14 is switchable between an independent position 27 for blocking the communication of the hydraulic fluid in the communication passage j, and a merging position 28 for allowing the communication of the hydraulic fluid in the communication passage j.

Accordingly, when the pilot pressure valve V14 is switched to the independent position 27, the hydraulic fluid from the first hydraulic-fluid discharge port P1 can be supplied to the direction switching valves DV4, DV3 of the right track control valve V4, and the dozer first control valve V3, respectively, and at the same time, the hydraulic fluid from the second hydraulic-fluid discharge port P2 can be supplied to the direction switching valves DV5, DV6 of the left track control valve V5 and the dozer second control valve V6, respectively. Further, the hydraulic fluid from the first hydraulic-fluid discharge port P1 is not supplied to the left track control valve V5 and the dozer second control valve V6, and the hydraulic fluid from the second hydraulic-fluid discharge port P2 is not supplied to the right track control valve V4 and the dozer first control valve V3.

When the pilot pressure valve V14 is switched to the merging position 28, the hydraulic fluid from the first hydraulic-fluid discharge port P1 and the hydraulic fluid from the second hydraulic-fluid discharge port P2 are merged and the resultant hydraulic fluid can be supplied to the direction switching valves DV1 to DV10 of the control valves V1 to V10, respectively.

The third hydraulic-fluid discharge port P3 is connected to the inlet block B2 via a third discharge channel m. The third discharge channel m is branched into a first branch fluid channel m1 and a second branch fluid channel m2 which are then connected to the inlet block B2.

The first branch fluid channel m1 is connected to, via a first signal fluid channel n1, a pressure receiver 14*a* at one side of the pilot pressure valve V14, and the second branch fluid channel m2 is connected to, via a second signal fluid channel n2, a pressure receiver 14*b* at the other side of the pilot pressure valve V14.

A first detection fluid channel r1 is connected to the first signal fluid channel n1, and a second detection fluid channel r2 is connected to the second signal fluid channel n2.

The first detection fluid channel r1 extends, starting at the first signal fluid channel n1, in the sequence of the direction switching valve DV6 of the dozer second control valve V6, the direction switching valve DV5 of the left track control valve V5, the direction switching valve DV4 of the right track control valve V4, and the direction switching valve DV3 of the dozer first control valve V3, in this order, and then is connected to the drain fluid channel g.

The second detection fluid channel r2 extends, starting at the second signal fluid channel n2, in the sequence of the direction switching valve DV10 of the SP control valve V10, the direction switching valve DV9 of the swing control valve V9, the direction switching valve DV8 of the swivel control valve V8, the direction switching valve DV7 of the arm control valve V7, the direction switching valve DV6 of the dozer second control valve V6, the direction switching valve DV5 of the left track control valve V5, the direction switching valve DV4 of the right track control valve V4, the direction switching valve DV3 of the dozer first control valve V3, the direction switching valve DV2 of the boom control valve V2, and the direction switching valve DV1 of the bucket control valve V1, in this order, and then is connected to the drain fluid channel g.

When the direction switching valves DV1 to DV10 of the control valves V1 to V10 are at neutral positions, respectively, the pilot pressure valve V14 is maintained at the merging position 28 under the force of the spring.

Then, when any of the direction switching valves DV in the right track control valve V4, the left track control valve V5, the dozer first control valve V3, and the dozer second control valve V6 is moved from the neutral position, pressure is established in the first detection fluid channel r1 and the first signal fluid channel n1, and the pilot pressure valve V14 is switched from the merging position 28 to the independent position 27.

Therefore, in a case where the backhoe 1 just runs, in a case where the dozer device 7 is used when the backhoe 1 is running, or in a case where only the dozer device 7 is used, the hydraulic fluid from the first hydraulic-fluid discharge port P1 is supplied to the direction switching valves DV of the right track control valve V4 and the dozer first control valve V3, respectively, and the hydraulic fluid from the second hydraulic-fluid discharge port P2 is supplied to the direction switching valves DV of the left track control valve V5 and the dozer second control valve V6, respectively.

At this time, when any of the direction switching valves DV10, DV9, DV8, DV7, DV2, and DV1 in the SP control valve V10, the swing control valve V9, the swivel control valve V8, the arm control valve V7, the boom control valve V2, and the bucket control valve V1 is moved from the neutral position, pressure is established in the second detection fluid channel r2 and the second signal fluid channel n2, and the pilot pressure valve V14 is switched from the independent position 27 to the merging position 28.

In a case where the direction switching valves DV1 to DV10 of the control valves V1 to V10 are at the neutral positions, respectively, when any of the direction switching valves DV10, DV9, DV8, DV7, DV2, and DV1 in the SP control valve V10, the swing control valve V9, the swivel control valve V8, the arm control valve V7, the boom control valve V2, and the bucket control valve V1 is moved from the neutral position, the pilot pressure valve V14 is set at the merging position 28.

In a non-running state or running state of the backhoe, the boom 15, the arm 16, the bucket 17, the swing bracket 14, the swivel base 10, and the dozer device 7 can be operated concurrently.

Further, the hydraulic system includes an automatic idling control system (AI system) for automatically operating an accelerator of the engine E.

The AI system includes: a pressure switch 29 connected to the first branch fluid channel m1 and the second branch fluid channel m2 of the third discharge channel m, via a sensing fluid channel s and a shuttle valve V18; an electrical actuator for controlling a governor of the engine E; and a control device for controlling the electrical actuator. The pressure switch 29 is connected to the control device.

In the AI system, since when the direction switching valves DV1 to DV10 of the control valves V1 to V10 are at the neutral positions, respectively, pressure is not established in the first branch fluid channel m1 and the second branch fluid channel m2, the pressure switch 29 does not sense pressure and does not operate. In this state, the governor is automatically controlled by the electrical actuator or the like such that the rotational speed of the engine E is reduced to the idling speed.

When any one of the direction switching valves DV1 to DV10 of the control valves V1 to V10 is operated, pressure is established in the first branch fluid channel m1 or the second branch fluid channel m2, this pressure is sensed by the pressure switch 29, and the pressure switch 29 operates upon sensing the pressure. Then, a command signal is output from the control device to the electrical actuator or the like, and the governor is automatically controlled by the electrical actuator or the like such that the rotational speed of the engine E is increased to a preset accelerated speed.

This hydraulic system employs a load sensing system.

The load sensing system of the embodiment includes: the pressure compensation valves V11 provided in the respective control valves V1 to V10; the flow compensation piston 24 for controlling the swash plate of the first pump 21; the flow compensation valve V17 provided in the flow control section 19; the first and the second relief valves V12, V15; and the first and the second unloading valves V13, V16.

The load sensing system of the embodiment employs an after-orifice-type load sensing system in which the pressure compensation valves V11 are provided downstream of, in terms of the hydraulic fluid supply, the respective direction switching valves DV1 to DV10.

In this load sensing system, in a case where more than one of the hydraulic actuators, ML, MR, MT, and C1 to C5 provided in the backhoe 1 are concurrently operated, the pressure compensation valves V11 function to adjust the loads among the hydraulic actuators ML, MR, MT, C1 to C5. Whichever of the pressure compensation valves V11 in the control valves V1 to V10 that has a lower load pressure will generate a pressure loss equivalent to the corresponding differential pressure between the maximum load pressure and the load pressure acting on the corresponding control valve (V1 to V10). Accordingly, a flow rate corresponding to the extent of movement of the spool of the corresponding direction switching valves DV1 to DV10 can be realized (distributed), irrespective of the magnitude of the loads.

Moreover, in the load sensing system, the discharge flow rate of the first pump 21 is controlled in accordance with the load pressure of the hydraulic actuators ML, MR, MT, and C1 to C5 provided in the backhoe 1, and the hydraulic power at a level required by the loads is discharged from the first pump 21. Accordingly, power saving and maneuverability can be improved.

The load sensing system of the embodiment will be described further in detail.

The load sensing system includes a PLS signal fluid channel w and a PPS signal fluid channel x. The PLS signal fluid channel w transmits the maximum load pressure among the load pressures acting on the control valves V1 to V10 (hereinafter referred to as PLS signal pressure) to the flow compensation valve V17. The PPS signal fluid channel x transmits the discharge pressure of the first pump 21 (hereinafter referred to as PPS signal pressure) to the flow compensation valve V17.

The PLS signal fluid channel w extends in the sequence of the first outlet block B1, the valve body of the bucket control valve V1, the valve body of the boom control valve V2, the valve body of the dozer first control valve V3, the valve body of the right track control valve V4, in this order, then passes through the pilot pressure valve V14, and further extends in the sequence of the valve body of the left track control valve V5, the valve body of the dozer second control valve V6, the valve body of the arm control valve V7, the valve body of the swivel control valve V8, the valve body of the swing control valve V9, the valve body of the SP control valve V10, and the second outlet block B3, in this order. The PLS signal fluid channel w is connected to the pressure compensation valves V11 of the control valves, via load transmission lines y, respectively.

Further, the PLS signal fluid channel w passes through the second outlet block B3, and then connected to one end of the spool of the flow compensation valve V17. The PLS signal pressure acts on the one side of the spool of the flow compensation valve V17.

Moreover, the PLS signal fluid channel w is connected to the first unloading valve V13 and the drain fluid channel g in the first outlet block B1, and is connected to the second unloading valve V16 and the drain fluid channel g in the second outlet block B3.

When the pilot pressure valve V14 is at the merging position 28, a line w1, of the PLS signal fluid channel w, extending from the pilot pressure valve V14 to the first outlet block B1 and a line w2, of the PLS signal fluid channel w, extending from the pilot pressure valve V14 to the second outlet block B3 communicate with each other. When the pilot pressure valve V14 is switched from the merging position 28 to the independent position 27, the PLS signal fluid channel w is blocked by the pilot pressure valve V14.

Accordingly, when the pilot pressure valve V14 is switched to the independent position 27, the PLS signal fluid channel w is split into the line w1 in which the hydraulic fluid is supplied from the first hydraulic-fluid discharge port P1, and the line w2 in which the hydraulic fluid is supplied from the second hydraulic-fluid discharge port P2.

The PPS signal fluid channel x is provided so as to extend from the pilot pressure valve V14 to the other end of the spool of the flow compensation valve V17. The PPS signal fluid channel x communicates with the second hydraulic fluid supply channel e via a connection fluid channel z when the pilot pressure valve V14 is at the merging position 28, and the PPS signal pressure (the discharge pressure of the first pump 21) acts on the other end of the spool of the flow compensation valve V17. When the pilot pressure valve V14 is switched to the independent position 27, the PPS signal fluid channel x communicates with the drain fluid channel g via a relief fluid channel q, causing the PPS signal pressure to be zero.

A spring 30 and a differential pressure piston 31 which apply a control differential pressure to the flow compensation valve V17 are provided at the one end of the spool of the flow compensation valve V17.

In the hydraulic system having the above configuration, when the direction switching valves DV1 to DV10 of the control valves V1 to V10 are at the neutral positions, respectively, the pilot pressure valve V14 is at the merging position 28. The hydraulic system is configured such that, at this time, the distal end of the first hydraulic fluid supply channel d is blocked by the first unloading valve V13, and the distal end of the second hydraulic fluid supply channel e is blocked by the second unloading valve V16. Thus, when the discharge pressure (PPS signal pressure) of the first pump 21 increases and the difference between the PPS signal pressure and the PLS signal pressure (zero at this moment) becomes greater than the control differential pressure, the first pump 21 is controlled such that the discharge flow rate thereof is reduced, and the first and the second unloading valves V13, V16 are opened to drain the discharged fluid from the first pump 21 into the tank T.

Therefore, in this state, the discharge pressure of the first pump 21 is the pressure that is set by the first and the second unloading valves V13, V16, and the discharge flow rate of the first pump 21 is at the minimum.

Next, description will be given of a case where two or more of the boom cylinder C3, the arm cylinder C4, the bucket cylinder C5, the swing cylinder C2, the swivel motor MT, and the hydraulic attachment are concurrently operated, and a case where one or more of these and one or more of the left and the right track drive motors ML, MR, and the dozer cylinder C1 are concurrently operated.

In these cases, the pilot pressure valve V14 is at the merging position 28. The maximum load pressure of the load pressures acting on those hydraulic actuators (ML, MR, MT, and C1 to C5) which have been operated serves as the PLS signal pressure, and the discharge pressure (discharge flow rate) of the first pump 21 is automatically controlled such that "PPS signal pressure—PLS signal pressure" is equal to the control differential pressure (the difference between the PPS signal pressure and the PLS signal pressure is maintained at a set value).

That is, when the unloading flow rate via the first and the second unloading valves V13, V16 becomes zero, the discharge flow rate of the first pump 21 starts to increase, and the whole amount of the discharged fluid from the first pump 21 flows to the hydraulic actuators (ML, MR, MT, C1 to C5) which have been operated, in amounts in accordance with the extent of actuation of the control valves which have been operated, respectively.

Moreover, the differential pressure before and after the spool, of the direction switching valves (DV1 to DV10) of the control valves (V1 to V10) which have been operated, is made constant by the corresponding pressure compensation valves V11. Thus, irrespective of the magnitude of the loads acting on the hydraulic actuators (ML, MR, MT, and C1 to C5) which have been operated, the discharge flow rate of the first pump 21 is divided among, in accordance with the extent of actuation of, the hydraulic actuators (ML, MR, MT, and C1 to C5) which have been operated.

In a case where the flow rate required by the hydraulic actuators ML, MR, MT, and C1 to C5 exceeds the maximum discharge flow rate of the first pump 21, the discharged fluid from the first pump 21 is proportionally divided among the hydraulic actuators (ML, MR, MT, and C1 to C5) which have been operated.

In this case, concurrent operation (multiple operations) can be realized in an effective manner.

Next, description will be given of a case where the dozer device 7 performs earthwork when the backhoe 1 is running.

In this case, the pilot pressure valve V14 is switched to the independent position 27, the communication between the communication passage j and the PLS signal fluid channel w is blocked by the pilot pressure valve V14, the PPS signal fluid channel x communicates with the drain fluid channel g via the relief fluid channel q, and the PPS signal pressure becomes zero.

Accordingly, the hydraulic fluid from the first hydraulic-fluid discharge port P1 flows to the right track control valve V4 and the dozer first control valve V3, but does not flow to the left track control valve V5 and the dozer second control valve V6. Moreover, the hydraulic fluid from the second hydraulic-fluid discharge port P2 flows to the left track control valve V5 and the dozer second control valve V6, but does not flow to the right track control valve V4 and the dozer first control valve V3. Moreover, since the PPS signal pressure is zero, the swash plate angle of the first pump 21 becomes the maximum, and the first pump 21 discharges the hydraulic fluid at the maximum flow rate.

In the hydraulic system of the embodiment, the hydraulic fluid is evenly drawn by the dozer first control valve V3 and the dozer second control valve V6, through the first hydraulic fluid supply channel d and the second hydraulic fluid supply channel e, respectively, to be supplied to the dozer cylinder C1. Thus, the straightness in running of the backhoe 1 can be ensured.

In a case where the backhoe 1 is turned left or right, the pressure compensation valves V11 control the distribution of the flow rate. Therefore, even when the loads applied to the track drive motors ML, MR are high, and the load applied to the dozer cylinder C1 is low, hydraulic fluid exceeding the set flow rate does not flow into the dozer cylinder C1. Thus, an independent circuit configuration can be maintained in which the hydraulic fluid from the first hydraulic-fluid discharge port P1 is supplied to the right track control valve V4, and the hydraulic fluid from the second hydraulic-fluid discharge port P2 is supplied to the left track control valve V5, independently, and the hydraulic fluid from the first hydraulic-fluid discharge port P1 and the hydraulic fluid from the second hydraulic-fluid discharge port P2 are evenly drawn. Accordingly, the hydraulic fluid supply flow rates to the left and the right the track drive motors ML, MR can be ensured, respectively, and thus the turning performance can be ensured.

If there is only one dozer control valve that controls the dozer cylinder, the dozer control valve is provided such that the hydraulic fluid is supplied to the dozer control valve from one of a first hydraulic fluid supply channel and a second hydraulic fluid supply channel. In such a case, when a part of the hydraulic fluid is drawn by the dozer cylinder through the one of the hydraulic fluid supply channels, there occurs a problem that the backhoe tends to run obliquely when it is supposed to run straight. Also, when the backhoe turns, since a great pressure loss occurs in the hydraulic fluid supply system in which the dozer control valve is provided, the moving speed of the backhoe is lowered (specifically, in a case where the dozer control valve is provided in the hydraulic fluid supply system extending from the first hydraulic-fluid discharge port P1, when the backhoe 1 turns left while operating the dozer device 7, the backhoe 1 runs as usual, but when the backhoe 1 turns right while operating the dozer device 7, the moving speed of backhoe 1 is lowered at the moment when the backhoe 1 operates the dozer device 7).

Another configuration may be considered in which one dozer control valve is provided to control the dozer cylinder and the hydraulic fluid is supplied to the dozer control valve from both of the first hydraulic fluid supply channel and the second hydraulic fluid supply channel. In this case, the straightness in running may be ensured but the turning performance is greatly reduced.

That is, when the backhoe turns, a great amount of hydraulic fluid flows into the dozer cylinder from the hydraulic fluid supply channels having a higher pressure, and thus the turning performance is greatly reduced.

Further, in this case, such a circuit configuration cannot specify which signal, that is, a signal representing the hydraulic fluid from the first hydraulic-fluid discharge port P1 or a signal representing the hydraulic fluid from the second hydraulic-fluid discharge port P2, is used as a basis for controlling the distribution of the flow rate. This results in difficult designing of the configuration of the load sensing system.

According to the embodiment, in a case where the backhoe 1 performs earthwork using the dozer device 7 while running, when the pilot pressure valve V14 is at the independent position 27, the PLS signal fluid channel w is also blocked. Therefore, no load signal interference occurs between the hydraulic fluid supply system extending from the first hydraulic-fluid discharge port P1 and the hydraulic fluid supply system extending from the second hydraulic-fluid discharge port P2. Thus, the hydraulic fluid is divided between the track control valves V4, V5, and between the dozer control valves V3, V6, and surplus hydraulic fluid is discharged from the unloading valves V13, V16, to the tank T. This control can be performed independently in the respective circuits of the hydraulic fluid supply system extending from the first hydraulic-fluid discharge port P1 and the hydraulic fluid supply system extending from the second hydraulic-fluid discharge port P2, and the function of the pressure compensation valves V11 can be ensured.

Further, also in a case where only the track body 2 or only the dozer device 7 is driven, as in the case where the backhoe 1 performs earthwork using the dozer device 7 while running, the pilot pressure valve V14 is switched to the independent position 27, the communication between the communication passage j and the PLS signal fluid channel w is blocked by the pilot pressure valve V14, and the PPS signal fluid channel x communicates with the drain fluid channel g via the relief fluid channel q, and the PPS signal pressure becomes zero.

Further, since the track control valves V4, V5 are arranged at most upstream positions in the hydraulic fluid supply systems extending from the hydraulic-fluid discharge ports P1, P2 of the first pump 21, respectively, the pressure loss in the hydraulic fluid conduits extending from the first pump 21 to the track drive motors ML, MR can be reduced.

In the hydraulic system having the above configuration, the first pump 21 employs a split-flow-type hydraulic pump, and the discharge flow rate from the first hydraulic-fluid discharge port P1 and the discharge flow rate from the second hydraulic-fluid discharge port P2 cannot be controlled independently of each other. The hydraulic system is configured such that in a case where the first hydraulic fluid supply channel d and the second hydraulic fluid supply channel e are independent of each other (the hydraulic fluid flows do not merge), the discharge flow rate of the first pump 21 is at the maximum. Alternatively, two independent hydraulic pumps may be provided and the discharge port of one of the two hydraulic pumps may be used as the first hydraulic-fluid discharge port P1, and the discharge port of the other of the two hydraulic pumps may be used as the second hydraulic-fluid discharge port P2. In this case, the hydraulic pumps are configured such that in a case where the pilot pressure valve V14 is at the independent position 27, the hydraulic pumps are controlled independently of each other, to discharge hydraulic fluid only at necessary flow rates, (in that case, the two hydraulic pumps may be controlled such that they discharge hydraulic fluid at their maximum flow rates concurrently in the merge state).

Still another configuration may be considered in which when only the dozer device 7 is operated, the pilot pressure valve V14 is set at the merging position 28. However, in this configuration, in a case where the dozer device 7 is operated when the backhoe is running, in order to maintain the pilot pressure valve V14 to be at the independent position 27, it is necessary to provide a third detection fluid channel for detecting that the direction switching valves DV3, DV6 of the dozer control valves V3, V6 have been operated, which results in a complicated circuit configuration of the detection circuit. In contrast, the hydraulic system of the embodiment is configured such that the first detection fluid channel r1 detects that the track control valves V4, V5 and/or the dozer control valves V3, V6 have been operated, thereby realizing a simpler circuit configuration of the detection circuit.

In the hydraulic system of the embodiment, the track control valves V4, V5 and the dozer control valves V3, V6 are arranged side by side, respectively, and one of the track control valves (V4) and one of the dozer control valves (V3), and the other of the track control valves (V5) and the other of the dozer control valves (V6) are arranged, with the pilot pressure valve V14 interposed therebetween. This allows a simpler circuit configuration of the detection circuit for detecting that the track control valves V4, V5 and/or the dozer control valves V3, V6 have been operated.

It should be noted that the arrangement of the control valves V1 to V10 and the inlet block B2 is not limited to the arrangement shown in the exemplary drawings. As long as one of the track control valves V4, V5, one of the dozer control valves V3, V6, and one of the outlet blocks B1, B3 are provided in one of the hydraulic fluid supply systems extending from two independent hydraulic-fluid discharge ports P1, P2, and the other of the track control valves V4, V5, the other of the dozer control valves V3, V6, and the other of the outlet block B1, B3 are provided in the other of the hydraulic fluid supply systems, the arrangement of the other control valves V1, V2, V7 to V10 is not limited specifically.

Moreover, the arrangement order of the control valves V1 to V10 is not limited.

While the present invention has been described in detail, the foregoing description is in all aspects illustrative and not restrictive. It will be understood that numerous other modifications and variations can be devised without departing from the scope of the present invention.

What is claimed is:

1. A hydraulic system for a working machine, the hydraulic system comprising left and right track devices configured to be driven by separate track drive motors, a dozer device configured to be driven by a dozer cylinder, track control valves provided respectively for the left and right track devices, and for respectively controlling the track drive motors, auxiliary control valves for controlling, apart from the track drive motors and the dozer cylinder, hydraulic actuators, and two independent hydraulic-fluid discharge ports, the hydraulic system comprising:

a pair of dozer control valves configured to be concurrently operable for controlling the dozer cylinder;

a pilot pressure valve configured to be switchable between an independent position and a merging position, the independent position being a position that allows, when the left and right track devices are operated while the auxiliary control valves are not operated, hydraulic fluid from one of the hydraulic-fluid discharge ports to be independently supplied to one of the track control valves and to one of the dozer control valves, and hydraulic fluid from the other of the hydraulic-fluid discharge ports to be independently supplied to the other of the track control valves and to the other of the dozer control valves, the merging position being a position that allows, when at least one of the auxiliary control valves is operated, the hydraulic fluid from the one of the hydraulic-fluid discharge ports and the hydraulic fluid from the other of the hydraulic-fluid discharge ports to be merged and then supplied to the at least one of the auxiliary control valves that has been operated, and to the track control valves and the dozer control valves; and pressure compensation valves provided respectively in the control valves, and configured to distribute hydraulic fluid to the respective control valves at flow rates in accordance with extent of actuation of, irrespective of the magnitude of loads acting on, the hydraulic actuators.

2. The hydraulic system for the working machine according to claim 1, wherein the control valves include direction switching valves, respectively, for switching the direction of the hydraulic fluid, the hydraulic system further comprising:

a first detection fluid channel for detecting that, when at least one of the direction switching valves of the track control valves and the dozer control valves is operated, the at least one of the direction switching valves has been operated, so as to cause the pilot pressure valve to be switched to the independent position; and a second detection fluid channel for detecting that, when at least one of the direction switching valves of the auxiliary control valves is operated, the at least one of the direction switching valves has been operated, so as to cause the pilot pressure valve to be switched to the merging position.

3. The hydraulic system for the working machine according to claim 2, wherein the control valves are arranged in one direction, the one of the track control valves and the one of the dozer control valves are arranged side by side, the other of the track control valves and the other of the dozer control valves are arranged side by side, and the one of the track control valves and the one of the dozer control valves, and the other of the track control valves and the other of the dozer control valves are arranged with the pilot pressure valve interposed therebetween.

4. The hydraulic system for the working machine according to claim 3, the hydraulic system further comprising:

a flow control section for automatically controlling a discharge flow rate of the hydraulic-fluid discharge ports, so as to maintain, at a set value, the difference between a discharge pressure of the hydraulic-fluid discharge ports and the maximum load pressure of load pressure(s) acting on an at least one of the hydraulic actuators having been operated;

a PLS signal fluid channel connected to the pressure compensation valves of the control valves via load transmission lines, respectively, and for transmitting, to the flow control section, the maximum load pressure of the load pressure(s) acting on the at least one of the hydraulic actuators having been operated, the PLS signal fluid channel being configured to be split into a line through which hydraulic fluid is suppliable from the one of the hydraulic-fluid discharge ports and a line through which hydraulic fluid is suppliable from the other of the hydraulic-fluid discharge ports, when the pilot pressure valve is set at the independent position; and unloading valves provided at a distal end of a hydraulic fluid supply channel in which the hydraulic fluid from the one of the hydraulic-fluid discharge ports flows, and at a distal end of a hydraulic fluid supply channel in which the hydraulic fluid from the other of the hydraulic-fluid discharge ports flows, respectively.

5. The hydraulic system for the working machine according to claim 2, the hydraulic system further comprising:

a flow control section for automatically controlling a discharge flow rate of the hydraulic-fluid discharge ports, so as to maintain, at a set value, the difference between a discharge pressure of the hydraulic-fluid discharge ports and the maximum load pressure of load pressure(s) acting on an at least one of the hydraulic actuators having been operated;

a PLS signal fluid channel connected to the pressure compensation valves of the control valves via load transmission lines, respectively, and for transmitting, to the flow control section, the maximum load pressure of the load pressure(s) acting on the at least one of the hydraulic actuators having been operated, the PLS signal fluid channel being configured to be split into a line through which hydraulic fluid is suppliable from the one of the hydraulic-fluid discharge ports and a line through which hydraulic fluid is suppliable from the other of the hydraulic-fluid discharge ports, when the pilot pressure valve is set at the independent position; and unloading valves provided at a distal end of a hydraulic fluid supply channel in which the hydraulic fluid from the one of the hydraulic-fluid discharge ports flows, and at a distal end of a hydraulic fluid supply channel in which the hydraulic fluid from the other of the hydraulic-fluid discharge ports flows, respectively.

6. The hydraulic system for the working machine according to claim 1, the hydraulic system further comprising:

a flow control section for automatically controlling a discharge flow rate of the hydraulic-fluid discharge ports, so as to maintain, at a set value, the difference between a discharge pressure of the hydraulic-fluid discharge ports and the maximum load pressure of load pressure(s) acting on an at least one of the hydraulic actuators having been operated;

a PLS signal fluid channel connected to the pressure compensation valves of the control valves via load transmission lines, respectively, and for transmitting, to the flow control section, the maximum load pressure of the load pressure(s) acting on the at least one of the hydraulic actuators having been operated, the PLS signal fluid channel being configured to be split into a line through which hydraulic fluid is suppliable from the one of the hydraulic-fluid discharge ports and a line through which hydraulic fluid is suppliable from the other of the hydraulic-fluid discharge ports, when the pilot pressure valve is set at the independent position; and unloading valves provided at a distal end of a hydraulic fluid supply channel in which the hydraulic fluid from the one of the hydraulic-fluid discharge ports flows, and at a distal end of a hydraulic fluid supply channel in which the hydraulic fluid from the other of the hydraulic-fluid discharge ports flows, respectively.

* * * * *